US006994759B1

(12) United States Patent
Koch

(10) Patent No.: US 6,994,759 B1
(45) Date of Patent: Feb. 7, 2006

(54) TREATMENT OF AN ALUMINUM ALLOY MELT

(75) Inventor: Hubert Koch, Rheinfelden (DE)

(73) Assignee: Aluminium Rheinfelden GmbH, Rheinfelden (DE)

( * ) Notice: Subject to any disclaimer, the term of this patent is extended or adjusted under 35 U.S.C. 154(b) by 0 days.

(21) Appl. No.: 09/719,900

(22) PCT Filed: Jun. 21, 1999

(86) PCT No.: PCT/IB99/01260

§ 371 (c)(1),
(2), (4) Date: Feb. 18, 2000

(87) PCT Pub. No.: WO00/00654

PCT Pub. Date: Jan. 6, 2000

(30) Foreign Application Priority Data

Jun. 26, 1998 (EP) ..... 98810594

(51) Int. Cl.
*C22C 21/06* (2006.01)

(52) U.S. Cl. ..... 148/549

(58) Field of Classification Search ..... 148/549
See application file for complete search history.

(56) References Cited

U.S. PATENT DOCUMENTS 2,336,512 A * 12/1943 Stroup ..... 75/147
4,661,172 A * 4/1987 Skinner et al.
5,540,791 A 7/1996 Matsuo et al.

FOREIGN PATENT DOCUMENTS

| | | |
|---|---|---|
| DE | 26 58 308 | 6/1978 |
| EP | 0 110 190 | 6/1984 |
| EP | 0 594 509 | 4/1994 |
| SU | 530919 | * 10/1976 |

OTHER PUBLICATIONS

Patent Abstracts of Japan, vol. 095, No. 011, Dec. 26, 1995 & JP 07 197177A (Sky Alum Co Ltd) Aug. 1, 1995.

* cited by examiner

*Primary Examiner*—Sikyin Ip
(74) *Attorney, Agent, or Firm*—Bachman & LaPointe, P.C.

(57) ABSTRACT

In a process to reduce the susceptibility to dross-forming of an aluminium alloy melt with a content of at least 2.5 w. % magnesium, to the melt is added 0.02 to 0.15 w. % vanadium and less than 60 ppm beryllium. By the addition of vanadium, the beryllium addition can be reduced and at the same time the dross-forming resistance of the melt increased.

9 Claims, No Drawings

TREATMENT OF AN ALUMINUM ALLOY MELT

The invention concerns a process to reduce the susceptibility to dross-forming an aluminium alloy melt with a content of at least 2.5 w. % magnesium.

On an interruption to work in a foundry, for example over holidays or a weekend, a metal melt ready for casting can be held for more than 50 hours at a melt temperature of 750° C. for example. After a long standing time, aluminium magnesium alloys with a high magnesium content have a tendency to dross-forming. The presence of magnesium in the melt causes the protective oxide skin, which normally prevents oxidation of the aluminium, to become permeable and the aluminium can react with oxygen. On the melt forms a cauliflower-like dross which consists mainly of spinel ($MgO.Al_2O_3$). This process is reinforced further in the cover heating furnace as the surface temperature of the metal bath, due to the radiant heat of the heating rods in the cover, is very high and convection in the metal bath is prevented by temperature layering. Because of the segregation due to gravitational force, magnesium becomes enriched close to the melt surface and leads to further reinforcement of this effect. The dross forming is very hard, has a cauliflower-like morphology and falls to the base of the crucible so that the entire furnace can be contaminated if the dross is not removed early enough. Scabbing commences earlier the higher the melt temperature.

It is known that the dross-forming of aluminium magnesium alloys can be reduced but not totally avoided by the addition of beryllium. It has been observed that the beryllium content of an aluminium magnesium alloy in the melt diminishes with time and evidently, when the beryllium concentration falls below a critical level, drosses rapidly begin to form on the melt. An increased addition of beryllium to the metal melt is undesirable because of the carcinogenic properties of beryllium and should therefore be avoided as far as possible.

The invention is therefore based on the task of using alloy technology measures to lead to a higher dross-forming resistance for aluminium magnesium alloys than is possible with an addition of beryllium according to the state of the art.

The task is solved according to the invention in that to the melt is added 0.02 to 0.15 w. % vanadium and less than 60 ppm beryllium.

Surprisingly it has been found that by the addition of vanadium, the dross-reducing addition of beryllium can take place in a substantially lower quantity than without the vanadium addition, where in general the addition of vanadium in a quantity of less than 0.05 w. % is sufficient even in alloys with a content of more than 5 w. % magnesium.

Preferably 0.02 to 0.08 w. % vanadium, in particular 0.02 to 0.05 w. % vanadium, is added to the melt.

For a content of more than 3.5 w. % magnesium, the addition of 25 to 50 ppm beryllium is sufficient, preferably 25 to 35 ppm beryllium. If the content of magnesium in the melt is less than 3.5 w. % less than 25 ppm beryllium is required to achieve a high dross-forming resistance. For lower requirements for the dross-forming tendency, the beryllium addition can even be omitted completely.

A preferred use of the process according to the invention lies in the production of casting alloys with 2.5 to 7 w. % magnesium
max 2.5 w. % silicon
max 1.6 w. % manganese
max 0.2 w. % titanium
max 0.3 w. % iron
max 0.2 w. % cobalt
less than 60 ppm beryllium
0.02 to 0.15 w. % vanadium and aluminium as the remainder and production-induced contaminants individually max 0.05 w. % and total max 0.15 w. %.

The process according to the invention is particularly referred for use in production of diecasting alloys.

Further advantages, features and details of the invention arise from the description of exemplary embodiments below.

Approximately 50 kg of a magnesium aluminium alloy with different beryllium and vanadium content in each case were melted in a crucible in the induction furnace. The crucible was then transferred to a resistance furnace and there held at a temperature of 750° C. The chemical analysis (in w. %) of the batches tested are summarised in table 1. Batches 1, 3 and 4 have a vanadium content according to the invention, batch 2 has a vanadium content lying outside the range according to the invention.

At specific time intervals, samples were taken from the different batches to determine the chemical composition. The melt surface was also observed at specific time intervals in order to determine the time of increased dross formation. Table 2 shows the time up to dross-scabbing the melt as a function of the beryllium and vanadium content of the alloy. The results suggest that at least in the tested aluminium magnesium alloys with a high magnesium content, a low quantity of beryllium need be present in the melt in addition to the proportion of vanadium according to the invention in order to achieve a high resistance to dross-forming. Secondly, with the addition of vanadium in the range according to the invention, a beryllium content of around 25 ppm is sufficient to increase substantially the dross-forming resistance.

TABLE 1

| Batch | Si | Fe | Cu | Mn | Mg | Cr | Zn | Ti | Be | V |
|---|---|---|---|---|---|---|---|---|---|---|
| 1 | 2.36 | 0.08 | <0.001 | 0.78 | 5.31 | <0.001 | 0.002 | 0.13 | 0.0011 | 0.072 |
| 2 | 2.30 | 0.08 | <0.001 | 0.74 | 5.69 | <0.001 | 0.01 | 0.11 | 0.0043 | 0.0052 |
| 3 | 2.37 | 0.08 | <0.001 | 0.79 | 5.28 | <0.001 | 0.002 | 0.12 | 0.0026 | 0.080 |
| 4 | 2.38 | 0.08 | <0.001 | 0.78 | 5.27 | <0.001 | 0.002 | 0.08 | 0.0026 | 0.072 |

TABLE 1-continued

| Batch | Si | Fe | Cu | Mn | Mg | Cr | Zn | Ti | Be | V |
|---|---|---|---|---|---|---|---|---|---|---|
| 5 | 2.47 | 0.11 | <0.001 | 0.70 | 6.29 | <0.001 | 0.006 | 0.13 | 0.0033 | 0.021 |
| 6 | 2.13 | 0.09 | <0.001 | 0.70 | 5.61 | <0.002 | 0.005 | 0.15 | 0.0025 | 0.045 |

TABLE 2

| Batch | Be content [ppm] | V content [w. %] | Time until Dross-Forming [h] |
|---|---|---|---|
| 1 | 11 | 0.072 | 68 |
| 2 | 43 | 0.005 | 63 |
| 3 | 26 | 0.080 | 158 |
| 4 | 26 | 0.072 | 139 *) |
| 5 | 33 | 0.021 | 160 *) |
| 6 | 25 | 0.045 | 171 *) |

*) Not drossed, test interrupted.

The invention claimed is:

1. Process which comprises: providing an aluminum alloy melt having a magnesium content of at least 2.5 wt. %; and reducing the susceptibility to dross-forming of said aluminum alloy melt by adding to said melt from 0.02 to 0.08 wt. % vanadium and from 25 to 50 ppm beryllium said aluminum alloy melt consisting essentially of 2.5 to 7 wt. % magnesium, max 2.5 wt. % silicon, max 1.6 wt. % manganese, max 0.2 wt. % titanium, max 0.3 wt. % iron, max 0.2 wt. % cobalt, and aluminum as the remainder.

2. Process according to claim 1, including adding to the melt from 0.02 to 0.05 wt. % vanadium.

3. Process according to claim 1, including providing an aluminum alloy melt having a magnesium content of at least 3.5 wt. %.

4. Process according to claim 3, including adding to the melt from 25 to 35 ppm beryllium.

5. Process according to claim 1, including the step of holding said melt at a temperature of 750° C.

6. Process according to claim 1, including the step of holding said alloy melt in melt condition including said vanadium and beryllium addition for a period of time.

7. Process according to claim 1, which comprises: providing an aluminum casting alloy melt having the following composition:

2.5 to 7 wt. % magnesium,
max 2.5 wt. % silicon,
max 1.6 wt. % manganese,
max 0.2 wt. % titanium,
max 0.3 wt. % iron,
max 0.2 wt. % cobalt, and aluminum as the remainder, and production-induced contaminants individually max 0.05 wt. % and total max 0.15 wt. %; and adding to said melt from 0.02 to 0.08 wt. % vanadium and from 25 to 50 ppm beryllium and thereby reducing the susceptibility to dross-forming of said aluminum casting alloy melt.

8. Process according to claim 7, which comprises providing an aluminum die casting alloy melt.

9. Process for forming an aluminum alloy comprising the steps of:

providing an aluminum alloy melt having a magnesium content of at least 2.5 wt. %; and reducing the susceptibility to dross-forming of said aluminum alloy melt by adding to said melt from 0.02 to 0.08 wt. % vanadium and from 25 to 50 ppm beryllium said aluminum alloy melt consisting essentially of 2.5 to 7 wt. % magnesium, max 2.5 wt. % silicon, max 1.6 wt. % manganese, max 0.2 wt. % titanium, max 0.3 wt. % iron, max 0.2 wt. % cobalt, and aluminum as the remainder; and holding said aluminum alloy melt for a period of time greater than 50 hours.

* * * * *